US010495394B2

(12) United States Patent
Bush

(10) Patent No.: US 10,495,394 B2
(45) Date of Patent: Dec. 3, 2019

(54) MID LOCK-UP RECEIVER

(71) Applicant: Vudoo Labs, Inc., St. George, UT (US)

(72) Inventor: Michael D. Bush, Somers, CT (US)

(73) Assignee: VUDOO LABS, INC., St. George, UT (US)

( * ) Notice: Subject to any disclaimer, the term of this patent is extended or adjusted under 35 U.S.C. 154(b) by 0 days.

(21) Appl. No.: 16/036,197

(22) Filed: Jul. 16, 2018

(65) Prior Publication Data

US 2019/0049200 A1 Feb. 14, 2019

Related U.S. Application Data

(60) Provisional application No. 62/544,047, filed on Aug. 11, 2017.

(51) Int. Cl.
*F41A 3/22* (2006.01)

(52) U.S. Cl.
CPC ..... *F41A 3/22* (2013.01)

(58) Field of Classification Search
CPC ..... F41A 3/22
See application file for complete search history.

(56) References Cited

U.S. PATENT DOCUMENTS 3,613,500 A * 10/1971 Warin ..... F41A 3/74 89/26
4,402,152 A * 9/1983 Casull ..... F41A 15/14 42/16
4,719,714 A * 1/1988 Palmisano ..... F41A 3/30 42/16
4,930,238 A * 6/1990 Poff, Jr. ..... F41A 3/22 42/16
7,966,762 B2 * 6/2011 Barrett ..... F41A 3/22 42/75.01
7,975,417 B2 * 7/2011 Duplessis ..... F41A 3/22 42/16
9,464,859 B2 * 10/2016 Potter ..... F41A 3/30
10,107,577 B2 * 10/2018 Kuhnle ..... F41A 3/26

FOREIGN PATENT DOCUMENTS

FR 1186980 A * 9/1959 ..... F41A 3/16

* cited by examiner

*Primary Examiner* — Joshua T Semick
(74) *Attorney, Agent, or Firm* — Bennet K. Langlotz; Langlotz Patent & Trademark Works, LLC

(57) ABSTRACT

Mid lock-up receivers have an elongated cylindrical body, the body defining a passage, the body having a first rear portion and a second forward portion adjacent to and forward of the rear portion, the first rear portion defining a first passage segment having a first diameter and the second forward portion defining a second passage segment having a second diameter greater than the first diameter, a forward facing step surface defined at a forward face of the first rear portion, an elongated cylindrical sleeve defining a sleeve passage and received in the second passage segment, the sleeve having a rear end spaced apart from the step surface, and the sleeve being compressively received in the body wherein the body is in tension about the sleeve, and the sleeve is compressed by the body. The sleeve may be thermally bonded to the body.

19 Claims, 8 Drawing Sheets

MID LOCK-UP RECEIVER

CROSS-REFERENCE TO RELATED APPLICATION

This application claims the benefit of U.S. Provisional Patent Application No. 62/544,047 filed on Aug. 11, 2017, entitled "Mid Lock Receiver Design," which is hereby incorporated by reference in its entirety for all that is taught and disclosed therein.

FIELD OF THE INVENTION

The present invention relates to firearms, and more particularly to a mid lock-up receiver having locking lugs on the bolt located midway through the receiver.

BACKGROUND OF THE INVENTION

Historically, the most common bolt action rimfire receivers use rear lock-up: the locking lugs are associated with the bolt handle and lock into the rear of the receiver. This design allows the receiver to be free from lug ways propagating through the receiver and terminating at the breech of the barrel. The rear lock-up manufacturing approach is easier and more economical than conventional methods for manufacturing a mid lock-up receiver, but the design produces a less accurate rifle than one with a mid lock-up receiver.

A less common, but more desired design, are mid lock-up receivers: the locking lugs on the bolt are located midway through the receiver. Forward of the bolt body is a bolt nose that remains stationary to the turning of the bolt body. Although the mid lock-up arrangement is preferred for rifle accuracy, it has generally been avoided because the design is more difficult and costly to manufacture. In addition, available manufacturing processes dictate the lug ways run the full length of the receiver without terminating at the abutments. This produces a less rigid receiver and minimal support for the bolt nose, which adversely affect rifle accuracy.

Prior art examples of mid lock-up receivers are the Remington 40X 22LR, Kelbly Swindlehurst, and Stiller Lonestar. It should be appreciated that only the Stiller Lonestar remains in production. Production of these receivers was short-lived because of their high manufacturing cost. In the case of the Kelbly and Stiller receivers, potential customers balked at purchasing them because of their perceived accuracy disadvantage resulting from them having lug ways continuing forward of the abutments.

Therefore, a need exists for a new and improved mid lock-up receiver that can be manufactured economically without lug ways that continue forward of the abutments. In this regard, the various embodiments of the present invention substantially fulfill at least some of these needs. In this respect, the mid lock-up receiver according to the present invention substantially departs from the conventional concepts and designs of the prior art, and in doing so provides an apparatus primarily developed for the purpose of providing a mid lock-up receiver that can be manufactured economically without lug ways that continue forward of the abutments.

SUMMARY OF THE INVENTION

The present invention provides an improved mid lock-up receiver, and overcomes the above-mentioned disadvantages and drawbacks of the prior art. As such, the general purpose of the present invention, which will be described subsequently in greater detail, is to provide an improved mid lock-up receiver that has all the advantages of the prior art mentioned above.

To attain this, the preferred embodiment of the present invention essentially comprises an elongated cylindrical body, the body defining a passage, the body having a first rear portion and a second forward portion adjacent to and forward of the rear portion, the first portion defining a first passage segment having a first diameter and the second portion defining a second passage segment having a second diameter greater than the first diameter, a forward facing step surface defined at a forward face of the first rear portion, an elongated cylindrical sleeve defining a sleeve passage and received in the second passage segment, the sleeve having a rear end spaced apart from the step surface, and the sleeve being compressively received in the body wherein the body is in tension about the sleeve, and the sleeve is compressed by the body. The sleeve may be thermally bonded to the body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
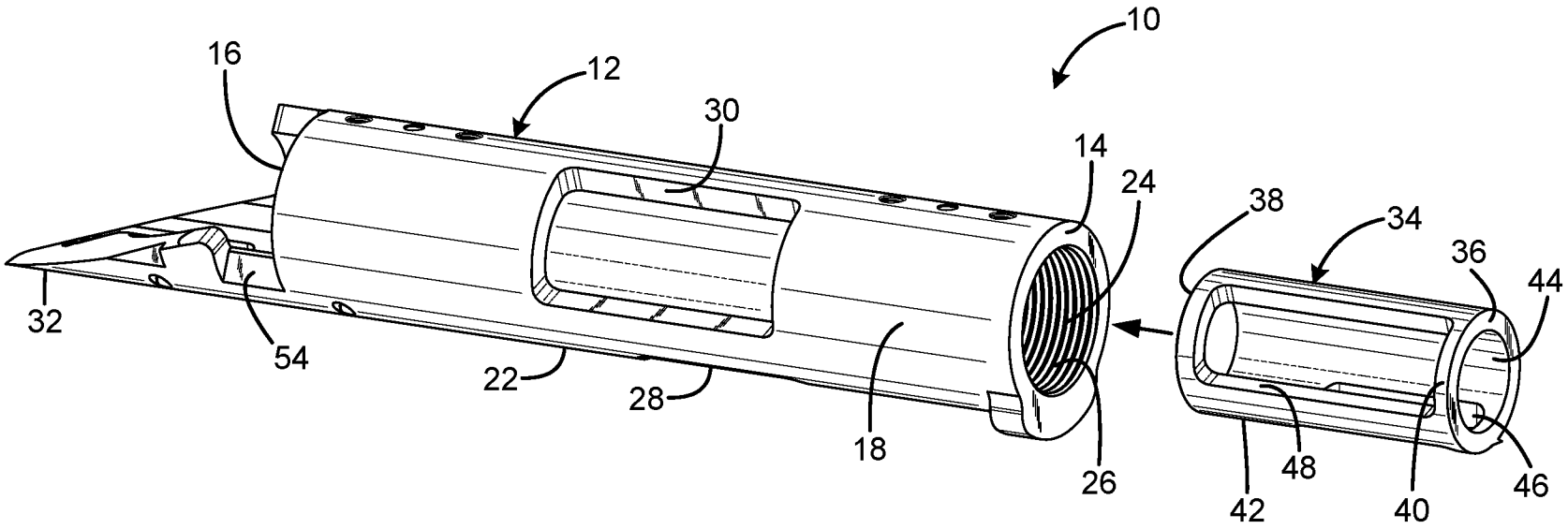
FIG. 1 is an exploded view of the current embodiment of the mid lock-up receiver constructed in accordance with the principles of the present invention.

A current embodiment of the mid lock-up receiver of the present invention is shown and generally designated by the reference numeral 10.

Figure 2:
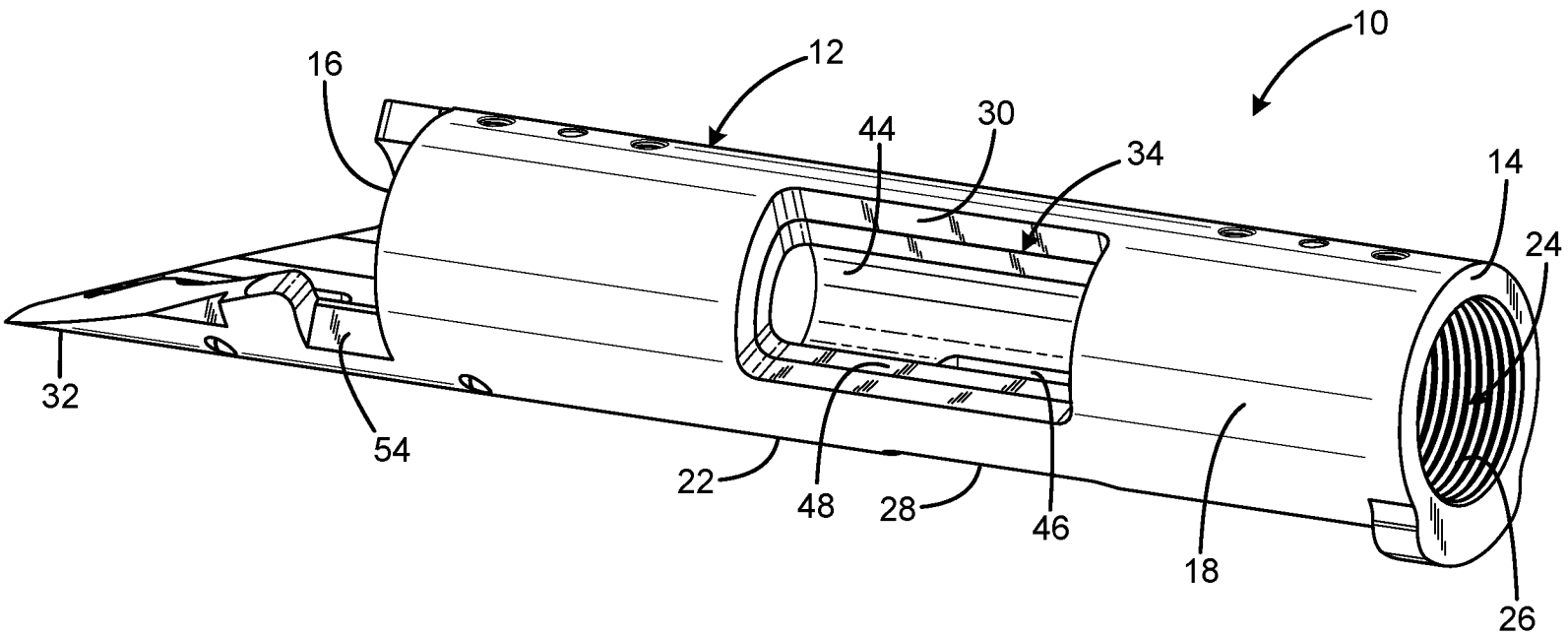
FIG. 2 is a front isometric view of the mid lock-up receiver of FIG. 1 with the insert installed.
Figure 4:
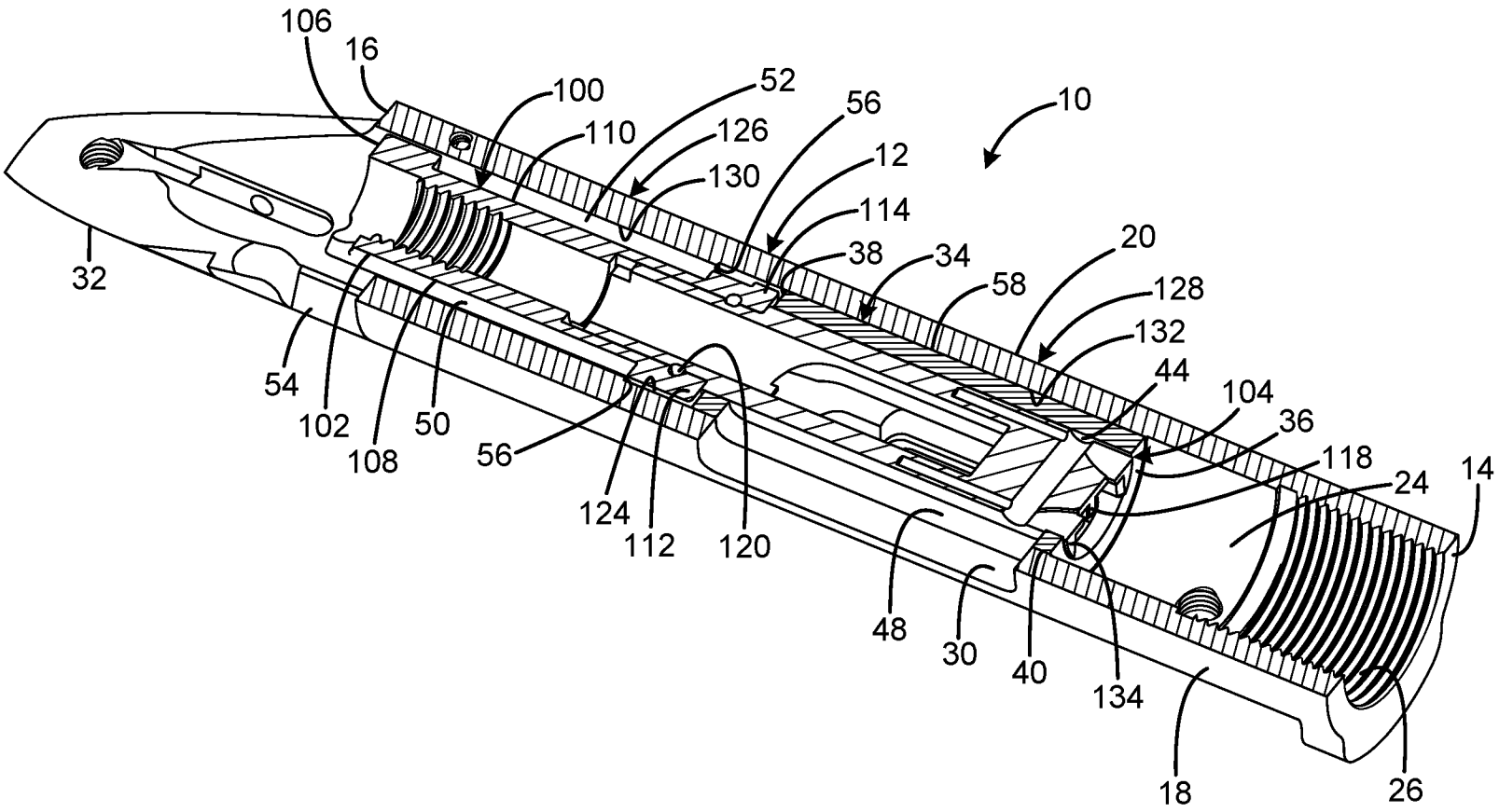
FIG. 4 is a front isometric sectional view of the mid lock-up receiver of FIG. 1 with the bolt in the locked position.
Figure 5:
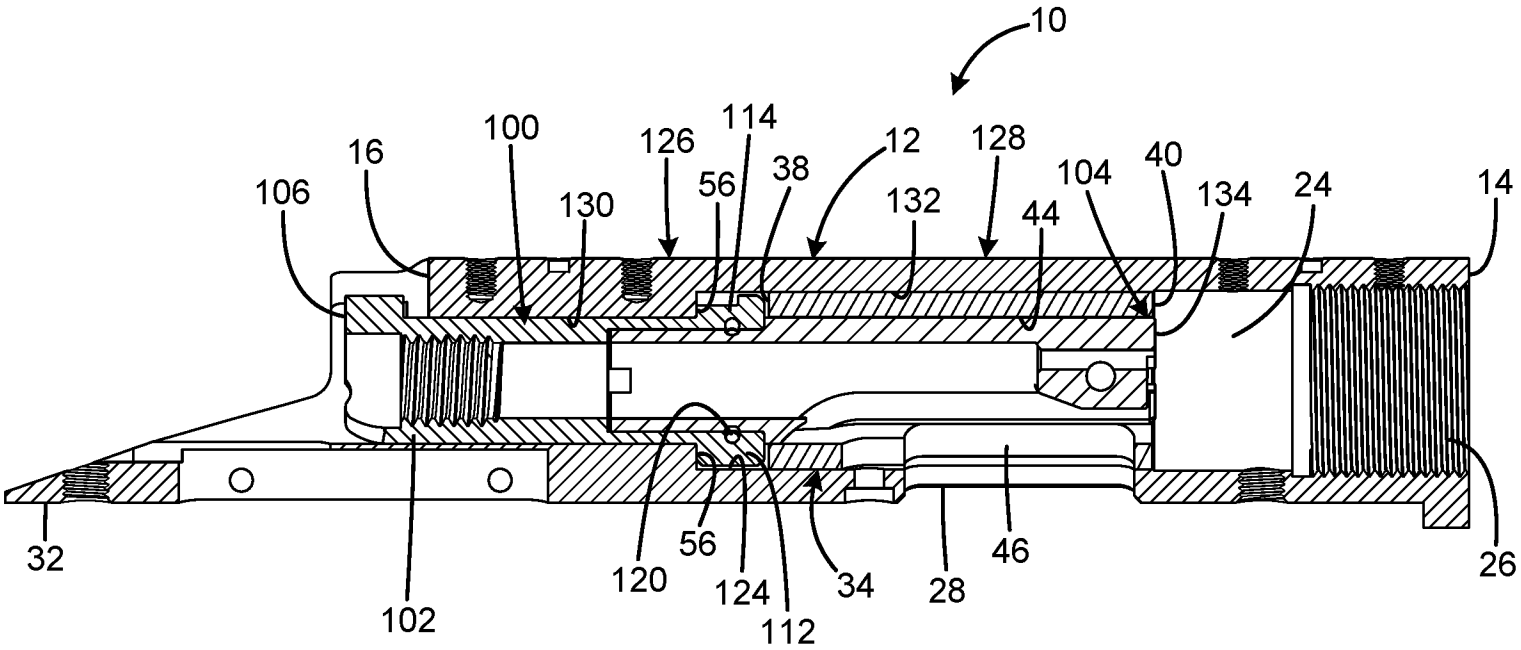
FIG. 5 is a side sectional view of the mid lock-up receiver of FIG. 1 with the bolt in the locked position.
Figure 6:
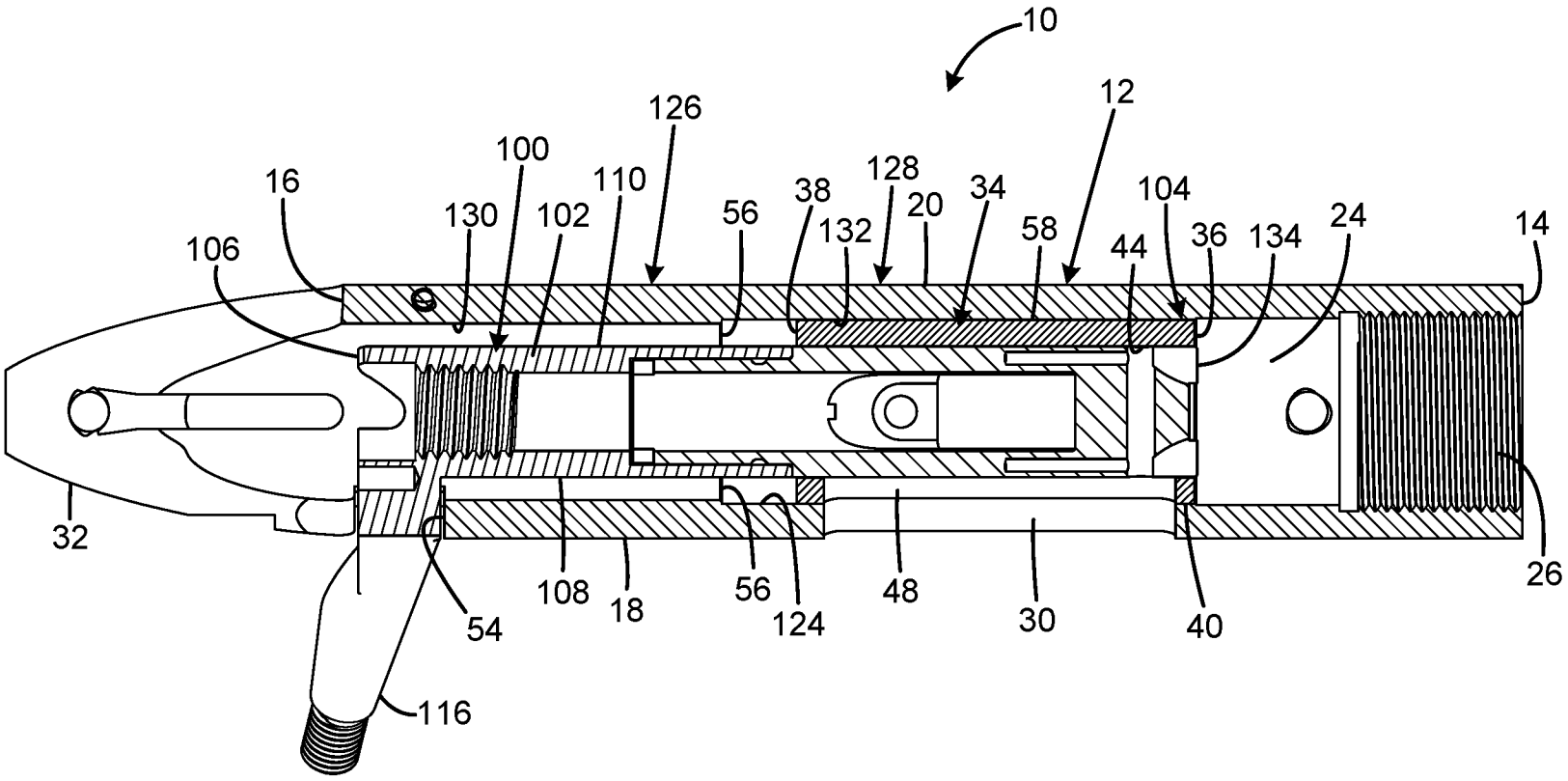
FIG. 6 is a top sectional view of the mid lock-up receiver of FIG. 1 with the bolt in the locked position.
Figure 7:
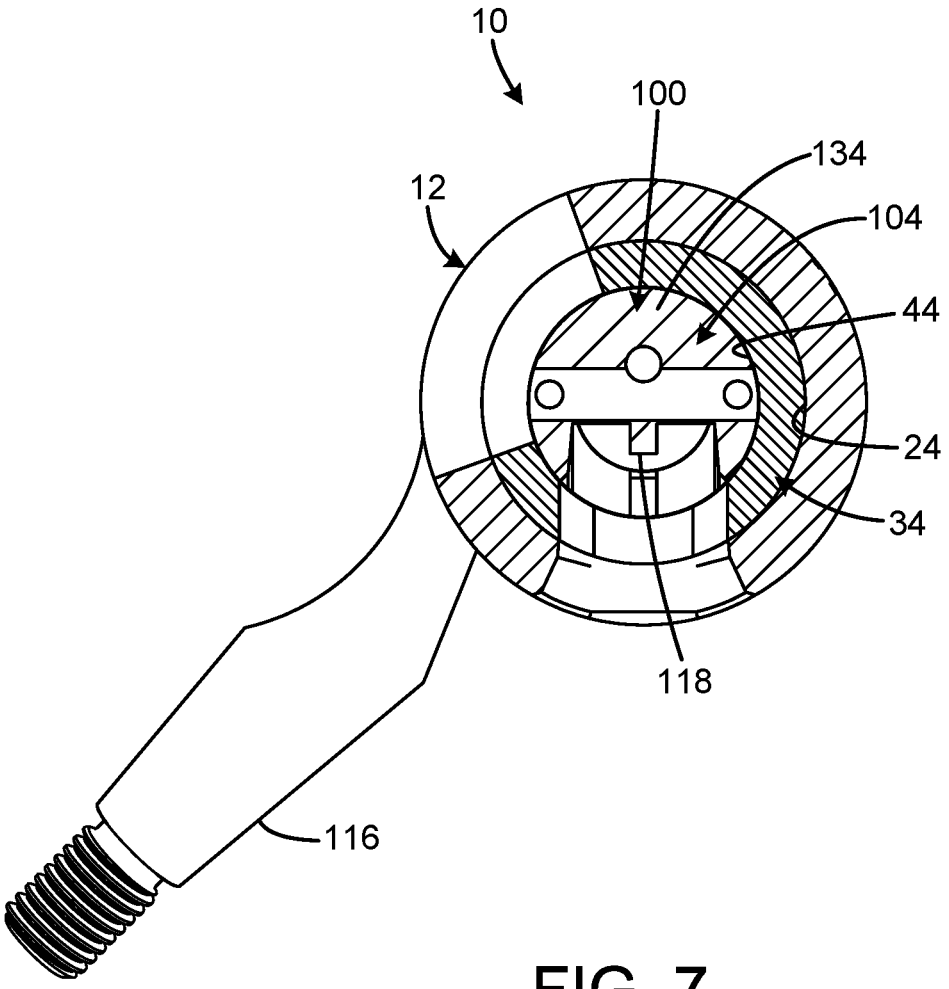
FIG. 7 is a rear sectional view of the mid lock-up receiver of FIG. 1 with the bolt in the locked position.
Figure 8:
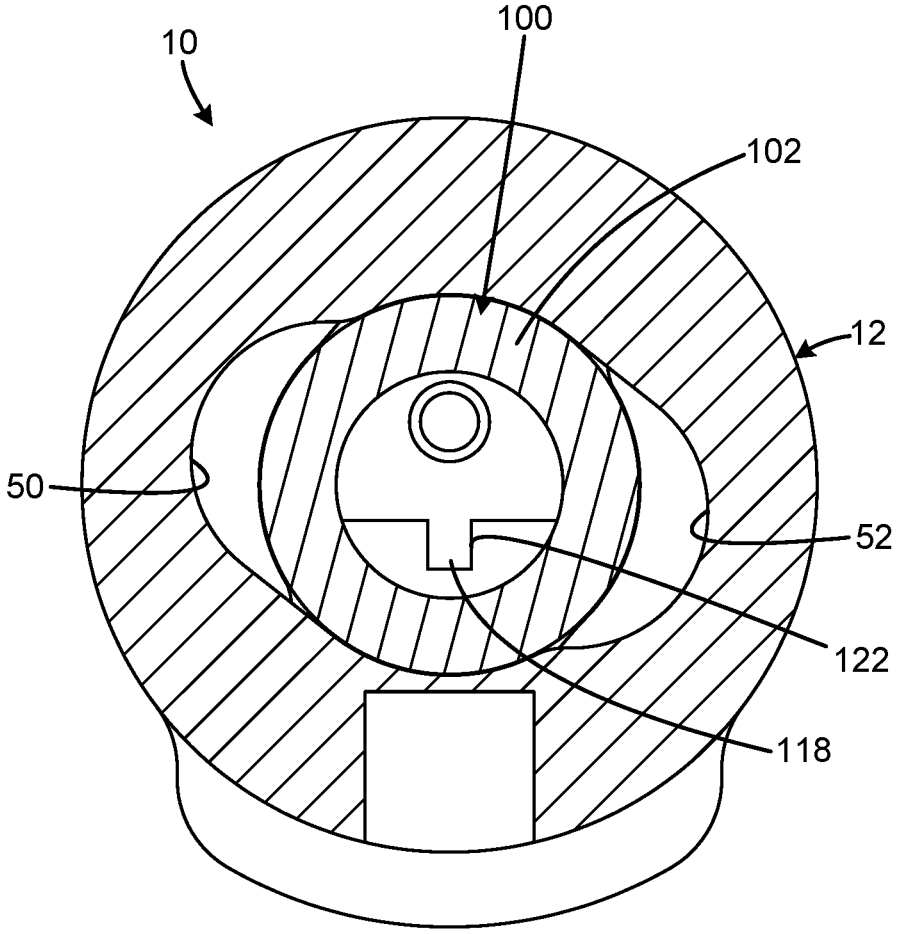
FIG. 8 is a front sectional view of the mid lock-up receiver of FIG. 1 with the bolt in the locked position.

FIGS. 1 & 2 illustrate the improved mid lock-up receiver 10 of the present invention. More particularly, the mid lock-up receiver has an elongated cylindrical receiver body 12 having a front 14, rear 16, right side 18, left side 20 (shown in FIG. 4), and bottom 22. The front and rear of the receiver body are open, defining a hollow interior passage 24. The front of the interior defines a threaded portion 26 that threadedly engages with the rear of a barrel (not shown) when the mid lock-up receiver is assembled into a rifle. The bottom of the receiver body defines a magazine aperture 28 that communicates with the interior and receives the top of a magazine (not shown) when the mid lock-up receiver is assembled into a rifle. The right side of the receiver body defines an ejection aperture 30 that communicates with the interior and enables spent cartridge casings to be expelled from the receiver body. A tang 32 that defines a bolt handle notch 54 protrudes rearwardly from the bottom rear of the receiver body.

An insert 34 is an elongate cylindrical sleeve received within the hollow interior 24 of the receiver body 12. The insert has a front 36, rear 38, right side 40, left side 58 (shown in FIG. 4), and bottom 42. The front and rear of the insert are open, defining a hollow interior sleeve passage 44. The bottom of the insert defines a magazine aperture 46 that communicates with the interior 44 and receives the top of a magazine (not shown) when the mid lock-up receiver 10 is assembled into a rifle. The right side of the insert defines an ejection aperture 48 that communicates with the interior 44 and enables spent cartridge casings to be expelled from the insert. It should be appreciated that the magazine aperture 46 and ejection aperture 48 of the insert are sized and positioned such that they are axially registered with the magazine aperture 28 and ejection aperture 30 of the receiver body when the insert is installed within the hollow interior of the receiver body.

Figure 3:
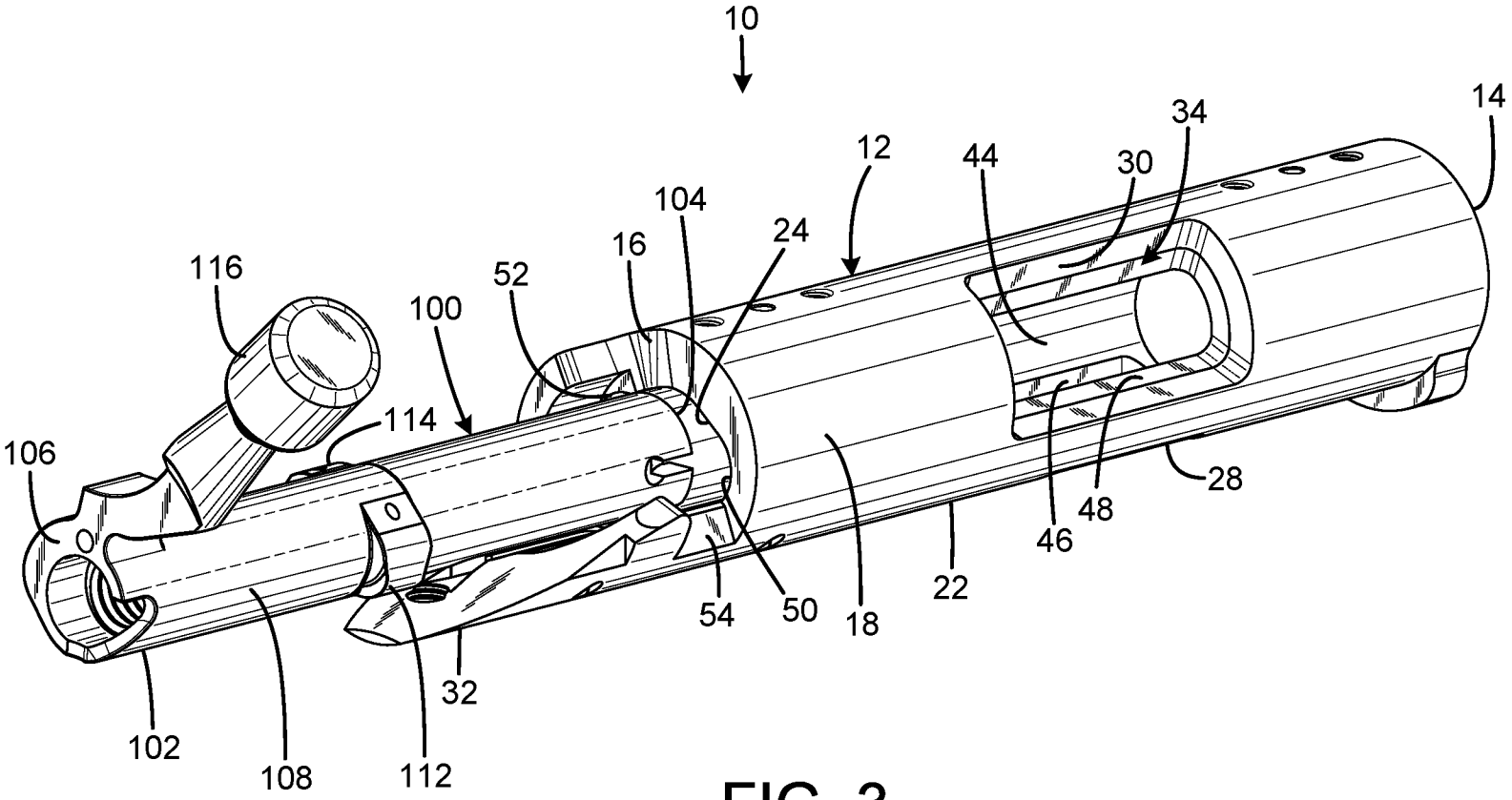
FIG. 3 is a rear isometric view of the mid lock-up receiver of FIG. 1 with the bolt in the unlocked position.

FIG. 3 illustrates the improved mid lock-up receiver 10 of the present invention. More particularly, the mid lock-up receiver is shown with a bolt 100 in the unlocked/out of battery position. The bolt has a bolt body 102 having a bolt nose 104, rear 106, right side 108, and left side 110 (shown in FIG. 4). A radiused right bolt lug 112 protrudes from the right side of the bolt body, and a radiused left bolt lug 114 protrudes from the left side of the bolt body. A bolt handle 116 protrudes from the rear right side of the bolt body.

The mid lock-up receiver 10 is intended to be used in a .22 rimfire bolt action rifle (not shown) in the current embodiment. The mid lock-up receiver is a turn-pull design: the user performs an upward lifting movement of the bolt handle 116 to disengage the bolt handle from the bolt handle notch 54 and to turn and unlock the bolt 100 from the breech and cock the firing pin, followed by pulling the bolt handle rearward to open the breech, extract the spent cartridge casing and eject the spent cartridge casing through the ejection apertures 30, 48. The user reverses the process to chamber the next cartridge by stripping a cartridge (not shown) from a magazine (not shown) protruding through the magazine apertures 28, 46 and relocking the breech via a lowering movement of the bolt handle into the bolt handle notch to turn and lock the bolt. The right and left bolt lugs 112, 114 secure the bolt in place as the rifle is fired. In the unlocked condition, the bolt can reciprocate fore and aft within the interior 24 because the right and left bolt lugs are slidably received within right and left radiused lug ways 50, 52, and the bolt nose is slidably received the interior 44 of the insert 34.

It should be appreciated that conventional bolt lugs have flats and corners, requiring conventional lug ways to be machined using the Electrical Discharge Machining (EDM) process. In contrast, the use of radiused right and left bolt lugs 112, 114 in the current invention eliminates the need for use in the costly EDM process to machine the right and left radiused lug ways 50, 52. Instead, the right and left radiused lug ways can be machined with typical, low-cost mill tools.

FIGS. 4-8 illustrate the improved mid lock-up receiver 10 of the present invention. More particularly, the mid lock-up receiver is shown with the bolt 100 in the locked/in battery position. The bolt has been pushed forward until the right and left bolt lugs 112, 114 have contacted the rear 38 of the insert 34, which prevents further forward movement of the bolt. The bolt handle 116 has then been lowered into the bolt handle notch 54, which has also rotated the right and left bolt lugs 112 such that rearward movement of the right and left bolt lugs and bolt is prevented by receiver abutments 56. The receiver abutments are forward-facing step surfaces that divide the body 12 into a first rear portion 126 and a second forward portion 128 adjacent to and forward of the first rear portion. The first rear portion defines a first passage segment 130 of the interior 24 having a first diameter, and a second forward portion defines a second passage segment 132 of the interior having a second diameter greater than the first diameter. The receiver abutments are defined at a forward face of the first portion. The insert 34 is received in the second passage segment with the rear end 38 of the sleeve spaced apart from the receiver abutments to define a bolt lug space 124. The bolt is of two-part construction with the bolt nose/face 104 being secured in a fixed orientation with respect to the receiver body 12 by alignment pin 118 received by channel 122. Thus, the bolt nose is a forward portion of the bolt forward of the lugs, and rotatable with respect to the lugs, that is rotationally engaged to the insert such that the bolt nose does not rotate when the right and left bolt lugs rotate. Only the rear 106 portion of the bolt, including the right and left bolt lugs, rotates as the bolt handle is raised and lowered. The rotation of the rear portion of the bolt relative to the bolt nose is enabled by O-ring 120. The forward bolt nose portion of the bolt is received in the sleeve passage 44 with a bolt face 134 positioned proximate to the front/forward end 36 of the insert. The rear portion of the bolt is received in the first passage segment.

It should be appreciated that the insert 34 of the current invention can be machined with typical, low-cost mill tools. The body and insert passages 24, 44 are accurately formed via highly precise fixturing and machining processes to ensure the passages are concentric after the insert is received within the body. The depth of insertion of the insert within the body is also established via highly precise fixtures. The fit between the insert and receiver is thermally set: the insert is submerged in liquid nitrogen before insertion. The receiver may be optionally heated before the insert is inserted. The insert subsequently warms to room temperature within the body and adheres via interference. Thus, the insert is thermally bonded to and compressively received in the body wherein the body is in tension about the insert, and the insert is compressed by the body. The body and insert are made of the same material, so they share the same thermal coefficient. This enables the body and insert to expand and contract together in response to environmental variations. The magazine apertures/ports 28, 46 and ejection apertures/ports 30, 48 are machined in the body and insert after the insert is installed in the receiver. This ensures the magazine apertures are axially registered with one another and the ejection apertures are axially registered with one another. The insert enables the radiused lug ways 50, 52 to terminate at the midpoint of the receiver body 12, thereby increasing the accuracy of a rifle using the mid lock-up receiver 10 relative to a rifle using a conventional rear lock-up receiver. Furthermore, the interior 44 of the insert closely receives the bolt nose 104, which enables the bolt nose to be supported and increases the rigidity of the mid lock-up receiver, thereby increasing the accuracy of a rifle using the mid lock-up receiver of the current invention relative to prior art mid lock-up receivers. Thus, the mid lock-up receiver of the current invention can be produced at a lower cost, produced more rapidly, and result in a rifle with greater accuracy than prior art rear and mid lock-up receivers.

A method of manufacturing the mid-lock up receiver 10, which is a bolt action firearm receiver in the current embodiment, includes the steps of: providing an elongated cylindrical body, generating in the body a first passage portion having a first diameter, generating in the body a second passage portion coaxial with the first passage portion having a second diameter greater than the first diameter, providing a sleeve having an exterior profile sized to be closely received in the second passage portion, generating in the sleeve a sleeve passage; establishing a body temperature greater than a sleeve temperature, and while the body is at a greater temperature than the sleeve, inserting the sleeve into the second passage portion as denoted by the arrow in FIG. 1. The step of inserting the sleeve may include positioning a rear end of the sleeve at a selected distance from the first passage portion. There may be a step of after inserting the sleeve, machining a magazine aperture and an ejection aperture in the body and sleeve. The step of machining a magazine aperture and an ejection aperture in the body and sleeve may include boring axially registered passages of a common shape. The step of establishing a body temperature greater than a sleeve temperature may include heating the body and chilling the sleeve.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a mid lock-up receiver has been described in detail, it should be apparent that modifications and variations thereto are possible, all of which fall within the true spirit and scope of the invention. For example, although use of the current invention with a .22 rimfire bolt action rifle has been described, it should be appreciated that the current invention is also suitable for use with rifles having rimfire single shot and repeater actions. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm bolt action receiver comprising:

an elongated cylindrical body;

the body defining a passage;

the body having a first rear portion and a second forward portion adjacent to and forward of the rear portion;

the first rear portion defining a first passage segment having a first diameter and the second forward portion defining a second passage segment having a second diameter greater than the first diameter;

a forward facing step surface defined at a forward face of the first rear portion;

an elongated cylindrical sleeve defining a sleeve passage configured to receive a forward portion of a firearm bolt and received in the second passage segment;

the sleeve having a rear end spaced apart from the step surface; and the sleeve being compressively received in the body wherein the body is in tension about the sleeve, and the sleeve is compressed by the body.

2. The firearm bolt action receiver of claim 1 wherein the sleeve is thermally bonded to the body.

3. The firearm bolt action receiver of claim 1 wherein the rear end of the sleeve and the step surface define a bolt lug space.

4. The firearm bolt action receiver of claim 1 including a bolt having a rear portion received in the first passage segment, and a forward portion received in the sleeve passage.

5. The firearm bolt action receiver of claim 4 wherein the bolt is an elongated body and includes bolt lugs extending laterally from an intermediate location along its length.

6. The firearm bolt action receiver of claim 4 wherein the bolt has a bolt face positioned proximate to a forward end of the sleeve.

7. The firearm bolt action receiver of claim 4 wherein the bolt has a forward portion forward of the lugs and rotatable with respect to the lugs.

8. The firearm bolt action receiver of claim 7 wherein the forward portion of the bolt is rotationally engaged to the sleeve such that it does not rotate when the lugs rotate.

9. The firearm bolt action receiver of claim 1 wherein the body defines a body ejection port and wherein the sleeve defines a sleeve ejection port registered with the body ejection port.

10. A method of manufacturing a bolt action firearm receiver comprising the steps:

providing an elongated cylindrical body;

generating in the body a first passage portion having a first diameter;

generating in the body a second passage portion coaxial with the first passage portion having a second diameter greater than the first diameter;

providing a sleeve having an exterior profile sized to be closely received in the second passage portion;

generating in the sleeve a sleeve passage;

establishing a body temperature greater than a sleeve temperature;

while the body is at a greater temperature than the sleeve, inserting the sleeve into the second passage portion; and after inserting the sleeve, machining a magazine aperture and an ejection aperture in the body and sleeve.

11. The method of claim 10 wherein inserting the sleeve includes positioning a rear end of the sleeve at a selected distance from the first passage portion.

12. The method of claim 10 wherein machining a magazine aperture and an ejection aperture in the body and sleeve may include boring axially registered passages of a common shape.

13. The method of claim 10 wherein establishing a body temperature greater than a sleeve temperature includes heating the body and chilling the sleeve.

14. A firearm bolt action receiver comprising:

an elongated cylindrical body;

the body defining a defining a passage;

the body having a first rear portion and a second forward portion adjacent to and forward of the rear portion;

the first rear portion defining a first passage segment having a first diameter and the second forward portion defining a second passage segment having a second diameter greater than the first diameter;

the second passage segment defining an ejection port;

a forward facing step surface defined at a forward face of the first rear portion;

an elongated cylindrical sleeve defining a sleeve passage and received in the second passage segment;

the sleeve having a rear end spaced apart from the step surface; and the sleeve being compressively received in the body wherein the body is in tension about the sleeve, and the sleeve is compressed by the body.

15. The firearm bolt action receiver of claim 14 wherein the sleeve is thermally bonded to the body.

16. The firearm bolt action receiver of claim 14 wherein the rear end of the sleeve and the step surface defining a bolt lug space.

17. The firearm bolt action receiver of claim 14 including a bolt having a rear portion received in the first passage segment, and a forward portion received in the sleeve passage.

18. The firearm bolt action receiver of claim 17 wherein the bolt is an elongated body and includes bolt lugs extending laterally from an intermediate location along its length.

19. The firearm bolt action receiver of claim 17 wherein the bolt has a bolt face positioned proximate to a forward end of the sleeve.

* * * * *